US009512555B2

(12) United States Patent
Garner

(10) Patent No.: US 9,512,555 B2
(45) Date of Patent: Dec. 6, 2016

(54) EXPANDABLE EXHAUST DUCT ASSEMBLY

(71) Applicant: Barry J. Garner, Lansing, KS (US)

(72) Inventor: Barry J. Garner, Lansing, KS (US)

( * ) Notice: Subject to any disclaimer, the term of this patent is extended or adjusted under 35 U.S.C. 154(b) by 39 days.

(21) Appl. No.: 14/588,058

(22) Filed: Dec. 31, 2014

(65) Prior Publication Data

US 2016/0186372 A1 Jun. 30, 2016

(51) Int. Cl.
*F16L 11/00* (2006.01)
*D06F 58/20* (2006.01)

(52) U.S. Cl.
CPC ..... *D06F 58/20* (2013.01)

(58) Field of Classification Search
CPC ... F16L 31/00; F16L 11/122; Y10T 29/49435; D06F 58/20
USPC ... 138/109, 118, 120; 285/260, 328; 34/134, 34/235, 606
See application file for complete search history.

(56) References Cited

U.S. PATENT DOCUMENTS 4,037,862 A * 7/1977 Thorp ..... F16L 31/00 285/260
5,318,328 A 6/1994 Dawson
5,368,341 A * 11/1994 Larson ..... B64F 1/362 138/119
5,970,623 A * 10/1999 Tuggle ..... D06F 58/20 34/134
6,286,876 B1 * 9/2001 Jasperse ..... B64F 1/362 138/156
6,370,794 B1 * 4/2002 Tuggle ..... D06F 58/20 285/147.1
D470,282 S 2/2003 Bjork
6,729,586 B2 * 5/2004 Arguijo ..... D06F 58/20 220/3.3
7,222,888 B1 * 5/2007 Piety ..... F16L 11/122 138/118
7,603,792 B1 10/2009 McDonald et al.
8,567,064 B1 * 10/2013 Wright ..... F16L 31/00 285/260
2001/0050480 A1 * 12/2001 Gooch ..... B64F 1/362 285/260
2002/0149201 A1 * 10/2002 Pichotta ..... F16L 25/0018 285/192
2004/0237330 A1 12/2004 Fuller
2005/0046183 A1 * 3/2005 Adams ..... F16L 31/00 285/260
2005/0052018 A1 3/2005 Pichotta
2005/0184524 A1 * 8/2005 Stravitz ..... D06F 58/20 285/409
2009/0197516 A1 8/2009 Wright et al.
2009/0221226 A1 9/2009 Gebke et al.

* cited by examiner

*Primary Examiner* — Patrick F Brinson

(57) ABSTRACT

A expandable duct assembly includes a dryer. A duct is structured to have resiliently expandable ends. The duct may be coupled between the dryer and an exhaust port. The duct directs an exhaust from the dryer to the exhaust port. A pair of strips is provided. The strips may be coupled to the dryer and the exhaust port. The duct engages the strips. The duct is retained on the dryer and the exhaust port.

6 Claims, 2 Drawing Sheets

EXPANDABLE EXHAUST DUCT ASSEMBLY

BACKGROUND OF THE DISCLOSURE

Field of the Disclosure

The disclosure relates to expandable exhaust duct devices and more particularly pertains to a new expandable exhaust duct device for attaching a duct between a dryer exhaust port and a home exhaust port.

SUMMARY OF THE DISCLOSURE

An embodiment of the disclosure meets the needs presented above by generally comprising a dryer. A duct is structured to have resiliently expandable ends. The duct may be coupled between the dryer and an exhaust port. The duct directs an exhaust from the dryer to the exhaust port. A pair of strips is provided. The strips may be coupled to the dryer and the exhaust port. The duct engages the strips. The duct is retained on the dryer and the exhaust port.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
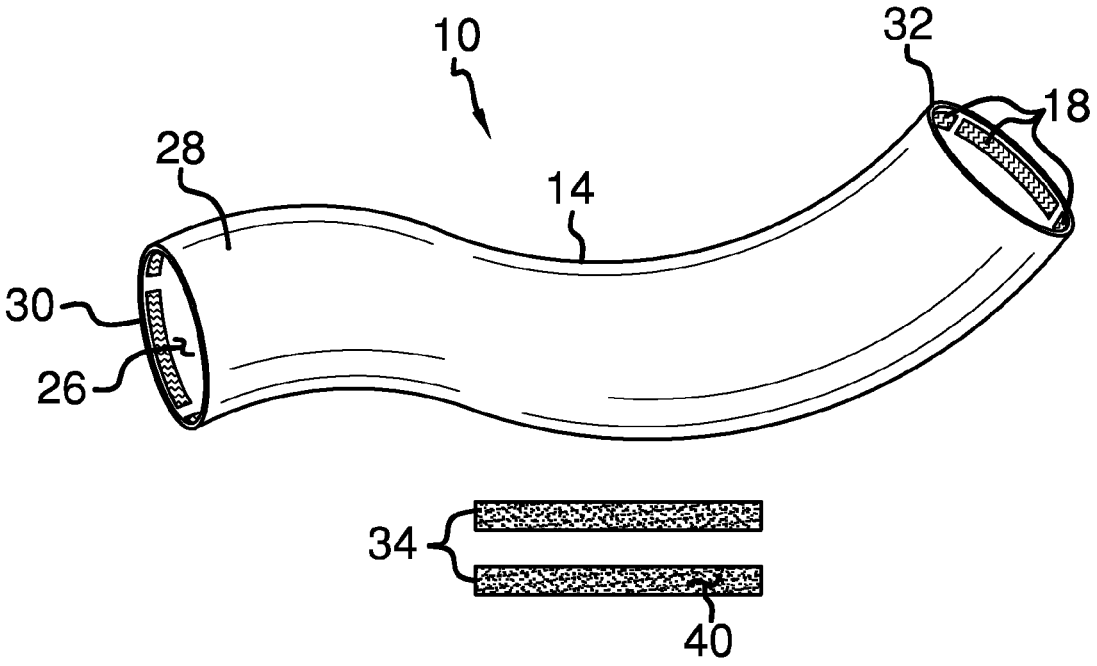
FIG. 1 is a perspective view of a expandable exhaust duct assembly according to an embodiment of the disclosure.
Figure 2:
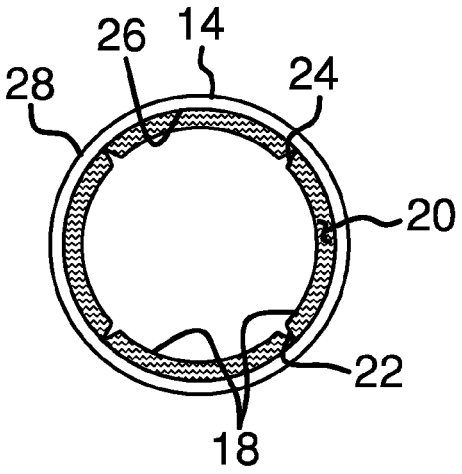
FIG. 2 is an end view of an embodiment of the disclosure.
Figure 3:
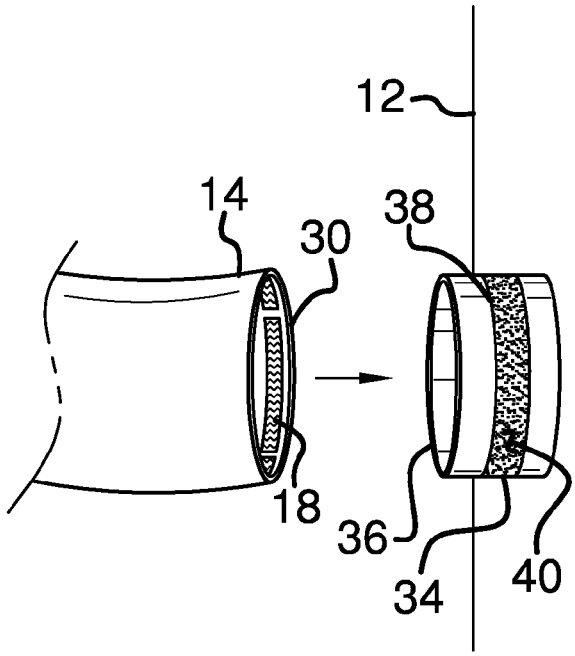
FIG. 3 is a top perspective view of an embodiment of the disclosure.
Figure 4:
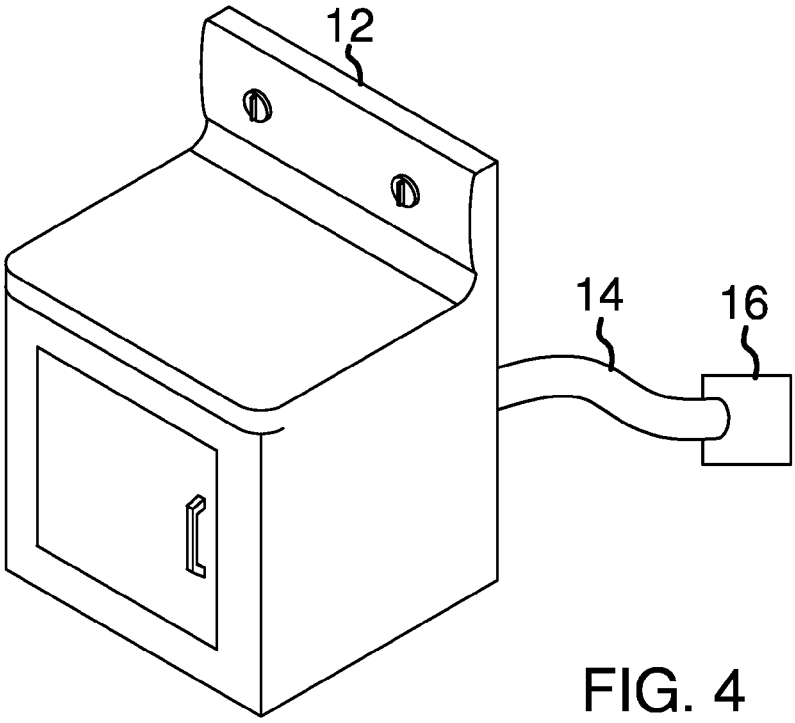
FIG. 4 is an in-use view of an embodiment of the disclosure.

With reference now to the drawings, and in particular to FIGS. 1 through 4 thereof, a new expandable exhaust duct device embodying the principles and concepts of an embodiment of the disclosure and generally designated by the reference numeral 10 will be described.

As best illustrated in FIGS. 1 through 4, the expandable exhaust duct assembly 10 generally comprises a dryer 12. The dryer 12 may be a household clothes dryer of any conventional design. A duct 14 is provided. The duct 14 is structured to have resiliently expandable ends. The duct 14 may be coupled between the dryer 12 and an exhaust port 16 so the duct 14 directs an exhaust from the dryer 12 to the exhaust port 16.

A plurality of couplers 18 is provided. The couplers 18 each has an outer surface 20 extending between a first end 22 and a second end 24 of the couplers 18. The outer surface

20 of the couplers 18 is coupled to an inside surface 26 of an outer wall 28 of the duct 14. The couplers 18 are evenly spaced apart and distributed around an entire inner circumference of the duct 14. The couplers 18 are positioned adjacent to each of a primary end 30 and a secondary end 32 of the duct 14. The couplers 18 may be comprised of a synthetic fiber such as nylon or other similar material.

A pair of strips 34 is provided. The strips 34 may be wrapped around an outlet 36 on the dryer 12 and the exhaust port 16. A bottom surface 38 of the strips 34 engages the outlet 36 and the exhaust port 16. The bottom surface 38 of the strips 36 may comprise an adhesive. The outer surface 20 of the couplers 18 engages a top surface 40 of the strips 34. The duct 14 is fluidly coupled between the dryer 12 and the exhaust port 16. Moreover, the strips 34 may comprise a hook and loop fastener of any conventional design.

In use, the strips 34 are wrapped around the outlet 36 on the dryer 12 and the exhaust port 16. The primary 30 and secondary 32 ends of the duct 14 are coupled to the outlet 36 and the exhaust port 16. The duct 14 may fit on any size outlet 36 and any size exhaust port 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An expandable duct assembly comprising:

a dryer;

a duct structured to have resiliently expandable ends such that said duct is configured to be coupled between said dryer and an exhaust port wherein said duct directs an exhaust from said dryer to the exhaust port, each of said resiliently expandable ends being defined by a constant circular edge;

a plurality of couplers having an outer surface extending between a first end and a second end of said couplers, said outer surface of said couplers being coupled to an inside surface of an outer wall of said duct, said couplers comprising first portions of hook and loop fastener; and a pair of strips configured to be coupled to said dryer and the exhaust port, said duct engaging said strips such that said duct is retained on said dryer and the exhaust port, said strips comprising second portion of hook and loop fastener complementary to said first portions of hook and loop fastener.

2. The expandable duct assembly according to claim 1, further comprising said couplers being evenly spaced apart and distributed around an entire inner circumference of said duct.

3. The expandable duct assembly according to claim 2, further comprising said couplers being positioned adjacent to each of a primary end and a secondary end of said duct.

4. The expandable duct assembly according to claim 1, further comprising said strips being wrapped around an outlet on said dryer and the exhaust port such that a bottom surface of said strips abuts said outlet and the exhaust port.

5. The expandable duct assembly according to claim 4, further comprising an outer surface of said couplers engaging a top surface of said strips such that said duct is fluidly coupled between said dryer and the exhaust port.

6. An expandable duct assembly comprising:

a dryer;

a duct structured to have resiliently expandable ends such that said duct is configured to be coupled between said dryer and an exhaust port wherein said duct directs an exhaust from said dryer to the exhaust port, each of said resiliently expandable ends being defined by a constant circular edge;

a plurality of couplers having an outer surface extending between a first end and a second end of said couplers, said outer surface of said couplers being coupled to an inside surface of an outer wall of said duct, said couplers being evenly spaced apart and distributed around an entire inner circumference of said duct, said couplers being positioned adjacent to each of a primary end and a secondary end of said duct, said couplers comprising first portions of hook and loop fastener; and a pair of strips configured to be wrapped around an outlet on said dryer and the exhaust port such that a bottom surface of said strips engages said outlet and the exhaust port, said outer surface of said couplers engaging a top surface of said strips such that said duct is fluidly coupled between said dryer and the exhaust port, said strips comprising second portion of hook and loop fastener complementary to said first portions of hook and loop fastener.

* * * * *